US010662964B2

(12) United States Patent
Hansen et al.

(10) Patent No.: US 10,662,964 B2
(45) Date of Patent: May 26, 2020

(54) RADIAL COMPRESSOR AND EXHAUST GAS RECIRCULATION SYSTEM

(71) Applicant: Howden Turbo GmbH, Frankenthal (DE)

(72) Inventors: Claus Smits Hansen, Påarp (SE); Joergen Lyquist, Alsgarde (DK)

(73) Assignee: Howden Turbo GmbH, Frankenthal (DE)

( * ) Notice: Subject to any disclaimer, the term of this patent is extended or adjusted under 35 U.S.C. 154(b) by 84 days.

(21) Appl. No.: 16/039,545

(22) Filed: Jul. 19, 2018

(65) Prior Publication Data

US 2019/0010951 A1 Jan. 10, 2019

Related U.S. Application Data

(63) Continuation of application No. PCT/EP2017/051881, filed on Jan. 30, 2017.

(30) Foreign Application Priority Data

Feb. 22, 2016 (EP) ..... 16156687

(51) Int. Cl.
*F04D 29/06* (2006.01)
*F04D 29/063* (2006.01)
(Continued)

(52) U.S. Cl.
CPC ..... *F04D 29/063* (2013.01); *F02M 26/34* (2016.02); *F04D 17/10* (2013.01);
(Continued)

(58) Field of Classification Search
CPC .... F04D 29/063; F04D 29/124; F04D 29/624; F04D 25/0606; F04D 29/122;
(Continued)

(56) References Cited

U.S. PATENT DOCUMENTS 9,897,092 B2 * 2/2018 Koga ..... F04D 17/122
10,006,356 B2 * 6/2018 Kemmerling ..... F02B 37/24
(Continued)

FOREIGN PATENT DOCUMENTS

DE 10 2008 059002 A1 7/2010
EP 2853749 A1 4/2015
(Continued)

OTHER PUBLICATIONS

Notification of Transmittal of International Preliminary Report on Patentability and the International Preliminary Report on Patentability for PCT/EP2017/051881, dated May 15, 2018.
(Continued)

*Primary Examiner* — Joseph J Dallo
(74) *Attorney, Agent, or Firm* — Edell, Shapiro & Finnan, LLC

(57) ABSTRACT

The invention relates to a radial compressor (2) comprising an impeller (4), a motor (8) for driving the impeller (4), which motor (8) exhibits a shaft (40), a housing (10) for the motor (8) and a distribution system (18) for a service fluid for the motor (8), wherein the distribution system (18) comprises a main feed (28), a manifold (36) and at least two feed branches (37, 38), wherein the service fluid can be conducted through the main feed (28), the manifold (36) and the at least two feed branches (37, 38), and wherein the main feed (28) and the feed branches (37, 38) join in the manifold (36). A radial compressor with an enhanced design may be achieved in that the distribution system (18) is an integral part of the housing (10) and in that the housing (10) comprises several housing parts (12, 14, 16), which are connected to each other and which are arranged adjacent to each other in longitudinal direction of the shaft (40), where the distribution system (18) extends through at least two of the housing parts (14, 16).

16 Claims, 4 Drawing Sheets

(51) Int. Cl.

| | |
|---|---|
| ***F04D 17/10*** | (2006.01) |
| ***F04D 29/42*** | (2006.01) |
| ***F04D 25/06*** | (2006.01) |
| ***F04D 29/62*** | (2006.01) |
| ***F04D 29/12*** | (2006.01) |
| ***F02M 26/34*** | (2016.01) |
| *F04D 29/056* | (2006.01) |

(52) U.S. Cl.
CPC ..... *F04D 25/0606* (2013.01); *F04D 29/122* (2013.01); *F04D 29/124* (2013.01); *F04D 29/4206* (2013.01); *F04D 29/624* (2013.01); *F04D 29/056* (2013.01); *F05D 2230/53* (2013.01)

(58) Field of Classification Search
CPC .... F04D 29/4206; F04D 17/10; F04D 29/056; F02M 26/34; F05D 2230/53
See application file for complete search history.

(56) References Cited

U.S. PATENT DOCUMENTS

| | | | |
|---|---|---|---|
| 2011/0243762 | A1 | 10/2011 | Daikoku et al. |
| 2013/0164114 | A1 | 6/2013 | Ervin et al. |
| 2015/0308456 | A1 | 10/2015 | Thompson et al. |

FOREIGN PATENT DOCUMENTS

| | | | |
|---|---|---|---|
| JP | 2000 034931 | A | 2/2000 |
| WO | 2010129189 | A1 | 11/2010 |
| WO | 2013122857 | A1 | 8/2013 |

OTHER PUBLICATIONS

Chinese Office Action in corresponding Chinese Patent Application No. 201780012473.5, dated Aug. 22, 2019, 18 pages with English Translation.

* cited by examiner

RADIAL COMPRESSOR AND EXHAUST GAS RECIRCULATION SYSTEM

CROSS-REFERENCE TO RELATED APPLICATIONS

This is a Continuation of PCT/EP2017/051881 filed on Jan. 30, 2017, which PCT claims the benefit of European Priority Application No.: 16156687.2 filed on Feb. 22, 2016, both of which are incorporated by reference herein in their entirety.

FIELD OF THE DISCLOSURE

The invention relates to a radial compressor comprising an impeller, a motor for driving the impeller, which motor exhibits a shaft, a housing for the motor and a distribution system for a service fluid for the motor. The distribution system comprises a main feed, a manifold and at least two feed branches, wherein the service fluid can be conducted through the main feed, the manifold and at least two feed branches. Moreover, the main feed and the feed branches join in the manifold.

SUMMARY AND BACKGROUND OF THE DISCLOSURE

Radial compressors, also called centrifugal compressors, of different types are used in various areas. One example is the exhaust gas recirculation (EGR) compressor, which can be used to reduce nitrogen oxide ($NO_x$) emissions caused by an engine like a petrol engine or a diesel engine. The EGR compressor is used particularly in different types of vehicles, for instance, in ships.

A common radial compressor comprises a motor with different bearings. Further, a common radial compressor comprises at least one sealing, particularly at the shaft of the compressor's motor. The common radial compressor has multiple external pipes (external pipework) to supply the bearings with oil and the sealing with sealing air.

One objective of the invention is to provide a radial compressor with an enhanced design, especially with a robust design.

This objective is accomplished by means of a radial compressor according to claim 1.

I.E., this objective is accomplished by means of a radial compressor of the type mentioned in the introduction, wherein, according to the invention, the distribution system is an integral part of the housing. Further, the housing comprises several housing parts, which are connected to each other and which are arranged adjacent to each other in longitudinal direction of the shaft. Moreover, the distribution system extends through at least two of the housing parts.

A housing for the motor in the meaning of this invention may be a housing, which is embodied to cover the motor. Further, a distribution system for a service fluid for the motor in the meaning of this invention may be a distribution system, which is embodied to conduct the service fluid to the motor.

An integral part of the housing in the meaning of this invention may be a direct part of the housing. Further, since the distribution system is an integral part of the housing, the distribution system may be incorporated into and/or worked into the housing. Particularly, the distribution system and the housing may comprise the same material. Thus, the distribution system and the housing may be manufactured from the same material. For instance, the distribution system and the housing may be formed in one piece, particularly at least partially.

The distribution system and/or at least one of its elements—particularly the main feed, the manifold and/or the feed branches—may be a cavity and/or a hollow space. Further, the distribution system and/or at least one of its elements may be formed by the walls of the housing. Further the distribution system and/or at least one of its elements may be drilled in the housing. Moreover, the walls of the distribution system can be uncoated, partially coated or coated.

Expediently, the several housing parts are separate housing parts. Each of the several housing parts may house a specific part of the radial compressor. For instance, a housing part can be a rear plate, a main housing and/or a bearing housing. Further, the distribution system may comprise several parts.

Each part of the distribution system or each group/subgroup of parts of the distribution system may be an integral part of the respective housing part. Preferably, each part of the distribution system or group/subgroup of parts of the distribution system and the respective housing part are formed in one piece. The housing parts can be connected by flanges with each other.

The invention is based on the observation that a radial compressor is often directly connected to an engine. Particularly, the radial compressor can be directly flange mounted to an engine. Thus, vibrations from the engine are transferred to the compressor. External pipes at the radial compressor are fragile and may break easily due to the vibrations during usage. Thus, the suggestion is to integrate former external supply elements like external pipes into the housing for the motor (following called housing). An integrated distribution system within the housing will be much more robust than external supply elements.

A further advantage is, that a radial compressor with an integrated distribution system will be much more compact than a radial compressor with external supply elements. Thus, the radial compressor with an integrated distribution system will be easy to handle, especially during the shipping process. Hence, the radial compressor will be robust during shipping as well as during usage.

By the fact that the several housing parts are arranged adjacent to each other in longitudinal direction of the shaft, the housing is more robust against vibrations than a housing, which e.g. is split along a centerline axis of the housing. Moreover, the risk of oil leakages is decreased by arranging the housing parts adjacent to each other in longitudinal direction of the shaft. Further, by the fact that the several housing parts are arranged adjacent to each other in longitudinal direction of the shaft, radial compressor may be easy to mount and, if necessary, easy to dismount. Moreover, the housing parts can be manufactured easily.

Since the distribution system extends through at least two of the housing parts, the housing may be easy to construct and easy to manufacture.

The distribution system may be a distribution system for an integrated supply of service fluid. Thus, the distribution system may conduct the service fluid directly within the housing. Particularly, the main feed may be a main feed for supplying the distribution system with the service fluid. For instance, the service fluid may enter the housing, particularly the distribution system, through the main feed. Further, the main feed may conduct the service fluid towards the manifold. Moreover, the manifold may conduct the service fluid into the feed branches.

Expediently, the manifold comprises a branching point/branching region for the feed branches and, if necessary, the main feed. In a preferred embodiment of the invention, the manifold may be a branching linker for the feed branches and, if necessary, the main feed. Hence, the manifold may be compact.

Further, it is advantageous that each feed branch is built by a conduit.

The at least two feed branches may be exactly two feed branches or more than two, e.g. three, four or even more, feed branches. The manifold may be configured according to the number of feed branches joining in the manifold.

Advantageously, at least one of the feed branches of the distribution system extends through at least two of the housing parts.

At least one feed branch may comprise several segments. Particularly, the at least one feed branch, which expediently extends through at least two of the housing parts, may comprise several segments. A first of the several segments may be arranged within one of the several housing parts. Further, a second of the several segments may be arranged within another of the several housing parts. Preferably, the first segment opens out into the second segment, and expediently vice versa.

It is preferred, if the radial compressor is a turbo compressor. Advantageously, the radial compressor is an exhaust gas recirculation compressor. An exhaust gas recirculation compressor normally is directly (flange) mounted to an engine. Thus, vibrations from the engine are transferred to the radial compressor. Especially in this case, it is expedient to integrate the distribution system into the housing so that the housing may get more robust and/or more compact.

In an advantageous embodiment of the invention, the service fluid is oil. Optionally, the service fluid may be another lubricating fluid. The service fluid may lubricate the motor of the radial compressor, particularly the shaft of the motor.

Preferentially, the radial compressor comprises at least one bearing. The at least one bearing may support and/or mount the shaft of the motor. Expediently, the main feed is inflow connection with the at least one bearing of the radial compressor, particularly to lubricate the bearing. The bearing may be oil lubricated. For instance, the bearing can be a journal bearing, a thrust bearing or a counter bearing. The distribution system, particularly the feed branches, may conduct the service fluid, i.e. the oil, to the at least one bearing. Hence, the distribution system conducts the service fluid to the motor, particularly to the bearings of the motor.

For instance, the radial compressor may comprise two or more bearings, which may be locally separated from each other. Each bearing can be a journal bearing, a thrust bearing or a counter bearing. Further, each feed branch may conduct service fluid to the respective bearing.

Advantageously, a service fluid supply is connectable to the distribution system, particularly to the main feed of the distribution system. The service fluid supply may supply the radial compressor, particularly rotating elements of the radial compressor, via the distribution system with service fluid.

Further, the distribution system, particularly the main feed, can comprise a connecting element, particularly for attaching the service fluid supply. For instance, the distribution system, particularly the main feed, can comprise a flange connection and/or a fitting, particularly to be able to connect the service fluid supply to the distribution system. Moreover, the flange connection and/or the fitting may be accessible directly from outside. Preferentially, the flange connection and/or the fitting are/is an integral part of the housing. Further it is possible, that the fitting may be a separate part, which is connected with the housing. By means of the flange connection and/or fitting, the service fluid supply is connectable to the distribution system, particularly to the main feed of the distribution system. Particularly, the flange connection and/or the fitting may be connectable with the service fluid supply.

In a preferred embodiment of the invention, the housing for the motor comprises a protrusion. Preferentially, the protrusion is an integral part of the housing. Further, the protrusion may comprise at least a part of the distribution system. The protrusion can be formed like a ligament, a slat, a bar and/or a fin or miscellaneous. Further, the protrusion can be formed corresponding to the form of the distribution system and/or parts of the distribution system.

Further, it is advantageous, if the housing for the motor comprises a base body, particularly a rotationally symmetric base body. Moreover, the protrusion may be arranged at the base body.

A protrusion in the meaning of this invention may include additional material at the housing, which may build up the distribution system at least partially.

The distribution system may have a complex form and/or may be a complex conduct system. The protrusion may comprise several protrusion parts, particularly to reproduce the complexity of the distribution system. Further, the distribution system may extend more than one housing part. Thus, also the protrusion may extend more than one housing part. Following, the protrusion may comprise several protrusion parts, wherein each protrusion part or each group/subgroup of protrusion parts may be an integral part of the respective housing part. Preferably, each protrusion part or each group/subgroup of protrusion parts and the respective housing part are formed in one piece.

The feed branch may comprise an arbitrary cross sectional form, particularly a round, ellipse-shaped or rectangular cross sectional form. Further, the feed branch comprises a diameter and/or a width. The cross sectional form and/or the diameter/width of the feed branch may change over a length of the feed branch. Preferentially, a diameter/width of the feed branch is an averaged width of a feed branch. A length of the feed branch may be at least 15 times, particularly at least 20 times, preferentially at least 25 times, even more preferred at least 30 times, of a diameter of the feed branch.

The housing of the motor may be formed arbitrarily. For instance, the housing of the motor can be formed rotationally symmetrically. The housing and/or the housing parts can have a length, a width and/or a diameter. With the distribution system being an integral part of the housing and/or of several housing parts, the length of the feed branch may be at least 60%, particularly at least 70%, preferentially at least 80%, of a diameter/a width of a housing and/or of the respective housing parts.

Further, the arrangement/design implies also a method for conducting a service fluid within the radial compressor described above.

Further, the radial compressor may comprise a gas supply system for a gas sealing of the motor. To provide a radial compressor with an enhanced design, especially with a robust design, the gas supply system may comprise a gas conduit and a fitting, wherein the gas conduit may be an integral part of the housing, through which gas conduit a gas can be conducted towards the gas sealing, and the fitting is arranged in the area of a hole top of the gas conduit.

Particularly the integrated gas conduit may allow a robust and/or compact radial compressor.

Preferably, the gas conduit is a cavity and/or a hollow space. The gas conduit may be formed by the walls of the housing.

The fitting may be screwed into the conduit, particularly into the hole top of the conduit. Thus, the fitting can be detachable and/or exchangeable. Further, the fitting may be glued into/pasted into the conduit, particularly into the hole top of the conduit. Moreover, the fitting may be pressed tightly into the conduit, particularly into the hole top of the conduit.

Expediently, the fitting is accessible directly from outside, particularly for supplying the gas conduit with the gas. The gas may be sealing air. Further, the gas can be a compressed gas.

Preferably, the gas conduit connects the fitting with the gas sealing of the radial compressor directly, particularly to seal the shaft of the motor. Further, the gas supply system may conduct the gas to the gas sealing. The gas sealing may be arranged on the shaft of the motor. Thus, the gas conduit may conduct the gas directly to the gas sealing.

Further, the gas conduit may be straight, particularly to have a short connection from the fitting to the gas sealing. The fitting may be arranged at the housing in a way, that the fitting is accessible. Moreover, the fitting may be arranged at the housing in a way, that the gas conduit is short, particularly as short as possible.

It is advantageous, if a gas supply is connectable to the fitting. The gas supply may supply the gas supply system with gas. Therefore, the fitting of the gas supply system may be a connecting element for attaching the sealing air supply.

The gas conduit may be uncoated, partially coated or coated. Further, the gas conduit may comprise an arbitrary cross sectional form, particularly a round, ellipse-shaped or rectangular cross sectional form. Moreover, the gas conduit comprises a diameter and/or a width. The cross sectional form and/or the diameter/width of the gas conduit can stay constantly and/or may change over a length of the gas conduit. Preferentially, a diameter/width of the gas conduit is an averaged width of a gas conduit. A length of the gas conduit may be at least 15 times, particularly at least 20 times, preferentially at least 25 times, even more preferred at least 30 times, of a diameter of the gas conduit.

The housing may comprise several housing parts. For instance, the gas supply system can be a part of one of the housing parts. Further, the housing of the motor may be formed arbitrarily. For instance, the housing of the motor can be formed rotationally symmetrically. The housing and/or the housing parts can have a length, a width and/or a radius. With the distribution system being an integral part of the housing and/or of one housing part, the length of the gas conduit may be at least 60%, particularly at least 70%, preferentially at least 80%, of a radius of the housing and/or of the respective housing part.

Preferentially, the gas sealing is working with compressed gas. Further, the gas sealing can be a labyrinth sealing. Alternatively, another gas sealing type is possible as well.

Further, the arrangement/design implies also a method for conducting a gas within the radial compressor described above.

Moreover, the invention relates to an exhaust gas recirculation system comprising the radial compressor according to the invention and/or an embodiment thereof. Further, the exhaust gas recirculation system comprises a combustion chamber.

According to the invention, an output of the combustion chamber is connected with an input of the radial compressor. The exhaust gas recirculation system may be embodied to conduct at least part of the exhaust of the combustion chamber to the radial compressor. Preferably, at least the part of the exhaust of the combustion chamber is compressed by means of the radial compressor.

Further, according to the invention, an output of the radial compressor is connected to an input of the combustion chamber. The exhaust gas recirculation system may be embodied to conduct at least the compressed exhaust to the combustion chamber.

A temperature of the combustion chamber during combustion may be reduced by means of the recirculation of at least part of the exhaust. Advantageously, less $NO_x$ is produced due to the lower combustion temperature. In this way, the exhaust gas recirculation system may reduce $NO_x$ emissions.

Even if terms are used in the singular or in a specific numeral form, the scope of the invention should not be restricted to the singular or the specific numeral form.

The previously given description of advantageous embodiments of the invention contains numerous features which are partially combined with one another in the dependent claims. Expediently, these features can also be considered individually and be combined with one another into further suitable combinations. More particularly, these features may be combined with the can and the method according to the respective independent claim individually as well as in any suitable combination. Furthermore, features of the method, formulated as apparatus features, may be considered as features of the can and, accordingly, features of the can, formulated as process features, may be considered as features of the method.

The above-described characteristics, features and advantages of the invention and the manner in which they are achieved can be understood more clearly in connection with the following description of exemplary embodiment which will be explained with reference to the drawings. The exemplary embodiment is intended to illustrate the invention, but is not supposed to restrict the scope of the invention to combinations of features given therein, neither with regard to functional features. Furthermore, suitable features of each of the exemplary embodiments can also be explicitly considered in isolation and/or be combined with any of the appended claims.

DETAILED DESCRIPTION

Figure 1:
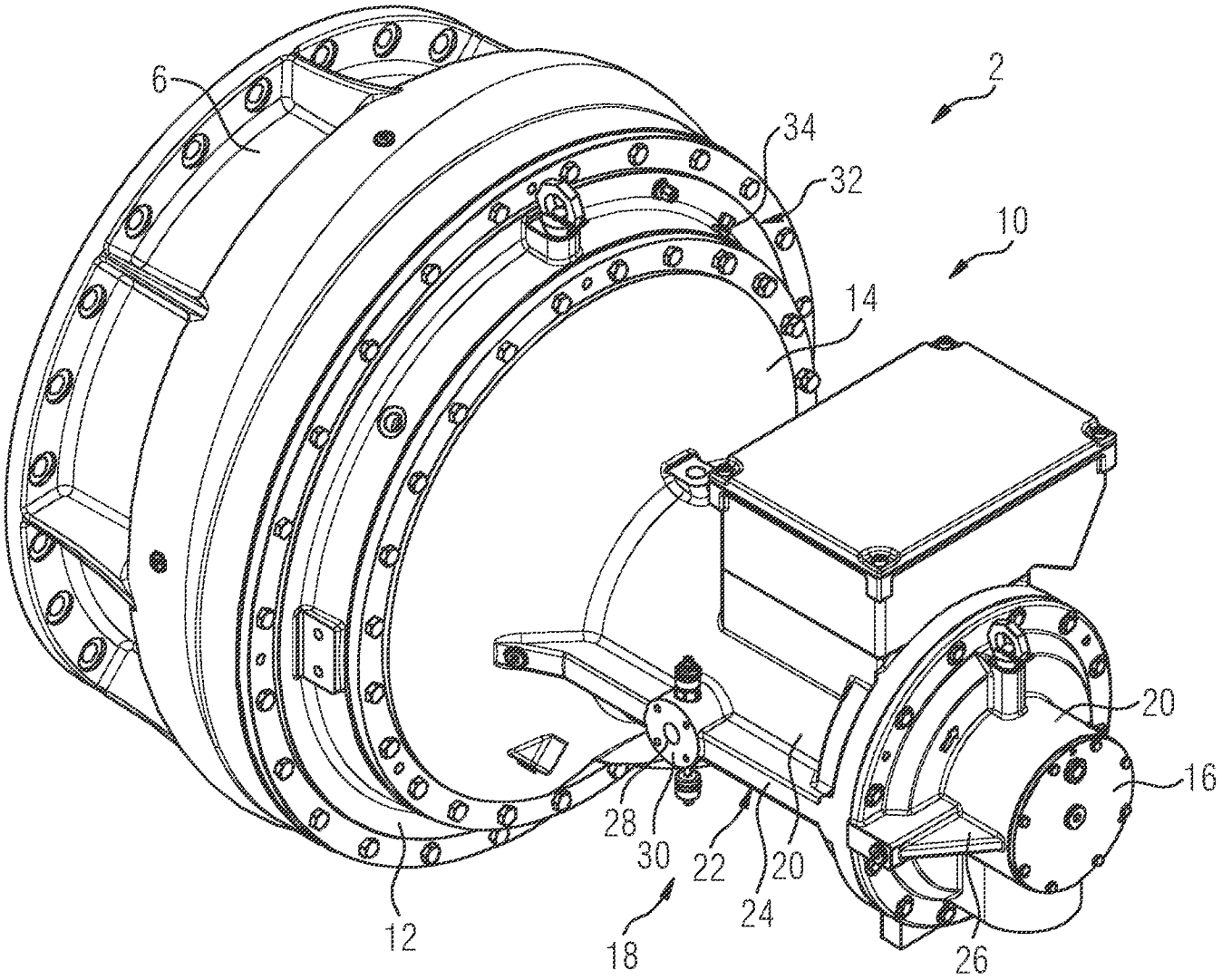
FIG. 1 is a schematic overview of a radial compressor.

FIG. 1 shows schematically a radial compressor 2. The radial compressor 2 is formed as an exhaust gas recirculation compressor.

The radial compressor 2 comprises an impeller 4 (see FIG. 2), a casing 6 for the impeller 4, a motor 8 (see FIG. 2) and a housing 10 for the motor 8. The motor 8 of the radial compressor 2 comprises a shaft 40 (see FIG. 2). Further, the housing 10 for the motor 8 comprises a first housing part 12, particularly a rear plate, a second housing part 14, particularly a main housing, and a third housing part 16, particularly a bearing housing. The housing parts 12, 14, 16 are connected by flanges with each other. Particularly, the first housing part 12 is connected directly to the second housing part 14 and the second housing part 14 is connected directly to the third housing part 16. Thus, the housing parts 12, 14, 16 are arranged adjacent to each other in longitudinal direction of the shaft 40 (see also FIG. 2). Further, the housing 10, particularly the first housing part 12, is connected directly to the casing 6 for the impeller 4 by a flange.

The housing 10 comprises a distribution system 18 for a service fluid for the motor 8. The distribution system 18 is an integral part of the housing 10. The service fluid is oil.

Further, the housing 10 for the motor 8 (following called housing 10) comprises a rotationally symmetric base body 20. Particularly, each of the housing parts 12, 14, 16 comprise a rotationally symmetric base body 20. Moreover, the housing 10 comprises a protrusion 22, wherein the protrusion 22 is arranged at the base body(s) 20 of the housing 10 and comprises at least a part of the distribution system 18. The protrusion 22 comprises a first protrusion part 24 and a second protrusion part 26. The first protrusion part 24 and the second housing part 14 are formed in one piece. Further, the second protrusion part 26 and the third housing part 16 are formed in one piece.

The distribution system 18 comprises a main feed 28. Accordingly, the protrusion 22 comprises the main feed 28. The main feed 28 supplies other elements 36, 37, 38 of the distribution system 18, i.e. a manifold 36 and feed branches 37, 38, with service fluid. Therefore, the main feed 28 can be connected with a service fluid supply (not shown). Further, service fluid can enter the housing 10 through the main feed 28.

The main feed 28 comprises a flange connection 30. Further, the flange connection 30 is accessible directly from outside. Thus, the service fluid supply can be connected by a flange to the main feed 28.

Further, the housing 10, particularly the first housing part 12, comprises a gas supply system 32 with a fitting 34.

Figure 2:
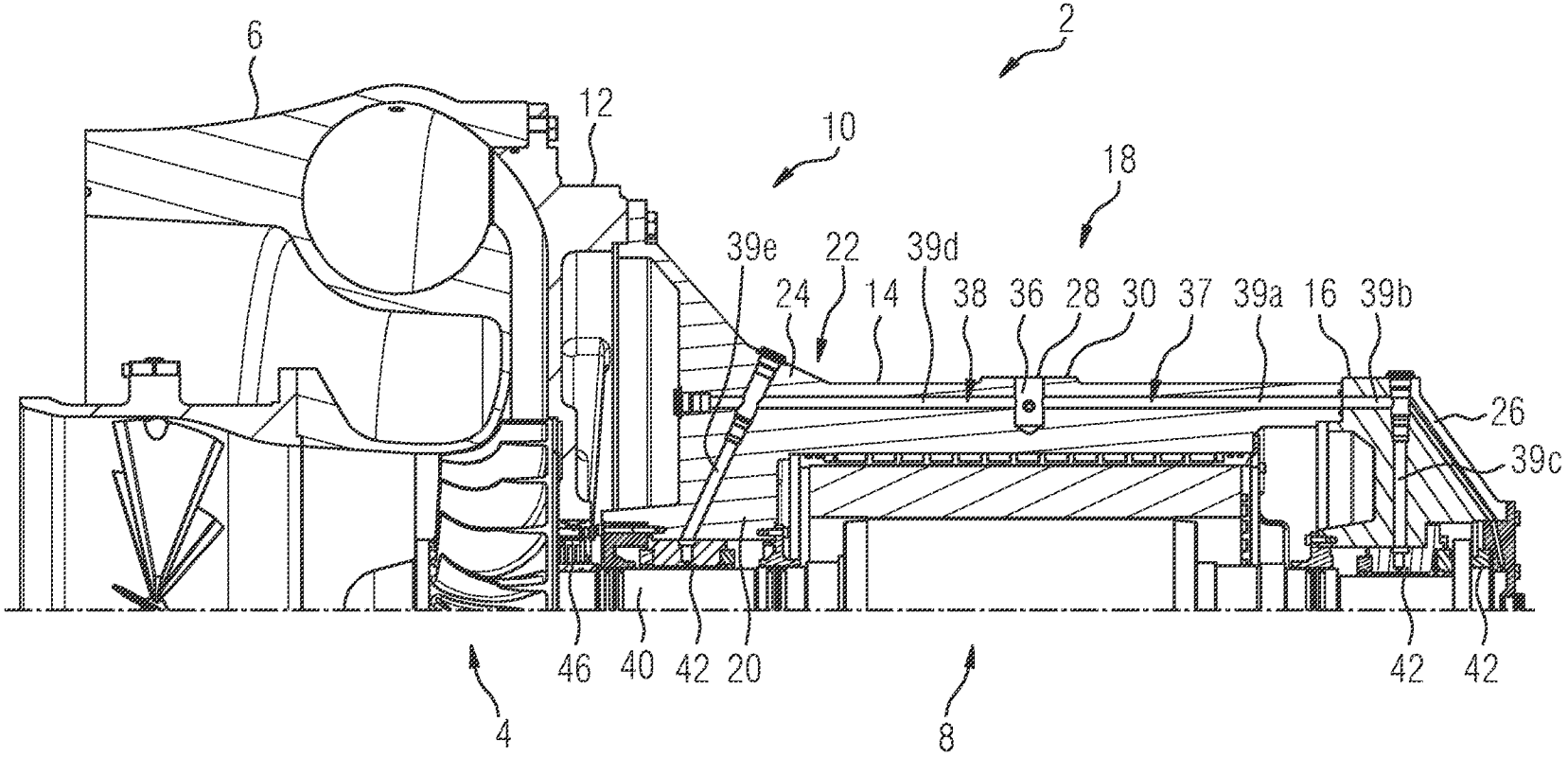
FIG. 2 is a schematic cross section of the radial compressor.

FIG. 2 shows a cross section of the radial compressor 2 shown in FIG. 1. The cross section was done along the distribution system 18 of the radial compressor 2.

The distribution system 18 is integrated into the housing 10 and comprises the main feed 28, the manifold 36 and two feed branches 37, 38, through which elements 28, 36, 37, 38 the service fluid can be/is conducted. In other words, the service fluid can be/is conducted through the main feed 28, the manifold 36 and the two feed branches 37, 38.

Further, the main feed 28 and the feed branches 37, 38 join in the manifold 36. Thus, the manifold 36 comprises a branching point/branching region for the feed branches 37, 38 and the manifold 36. Hence, the manifold 36 is a branching linker for the feed branches 37, 38 and the manifold 36. The distribution system 18 conducts the service fluid directly within the housing 10. For instance, the main feed 28 conducts the service fluid towards the manifold 36. Moreover, the manifold 36 conducts the service fluid into the feed branches 37, 38.

Each feed branch 37, 38 is built by a conduit. Thus, each feed branch 37, 38 is a hollow space formed by the walls of the housing 10. Particularly, the feed branches 37, 38 are formed by the protrusion 22 of the housing 10 as well as by the base body 20 of the housing 10 (of the respective housing part 14, 16). Each feed branch 37, 38 comprises several segments 39*a*-39*e*.

In the following, the feed branch 37 on the right hand side with respect to the drawing may be a first feed branch 37. Moreover, the feed branch 38 on the left hand side with respect to the drawing may be a second feed branch 38.

The distribution system 18 extends through two of the housing parts 14, 16, particularly through the second housing part 14 and the third housing part 16. Particularly, the first feed branch 37 (on the right hand side with respect to the drawing) extends through the housing parts 14 and 16. Further, the first feed branch 37 comprises a first segment 39*a*, which is arranged in the second housing part 14, and a second segment 39*b*, which is arranged in the third housing part 16. The first segment 39*a* of the first feed branch 37 opens out into the second segment 39*b* of the first feed branch 37.

Moreover, the feed branches 37, 38 extend at least partially in axial direction, i.e. parallel to the rotation axis of the shaft 40. Further, the feed branches 37, 38 extends at least partially in radial direction.

The first segment 39*a* of the first feed branch 37 as well as the second segment 39*b* of the first feed branch 37 extend in axial direction.

Moreover, the first feed branch 37 comprises a third segment 39*c*, which is arranged in the third housing part 16 and which extends in radial direction. The second segment 39*b* of the first feed branch 37 opens out into the third segment 39*c* of the first feed branch 37.

Also the second feed branch 38 (on the left hand side with respect to the drawing) comprises several segments 39*d*, 39*e*, wherein one of this segments 39*d* extends in axial direction and one of this segments 39*e* extends in radial direction. The two segments 39*d*, 39*e* of the second feed branch 38 opens out into each other.

The shaft 40 is connected with the impeller 4. The impeller 4 is overhung mounted. Further, the radial compressor 2 comprises several bearings 42, particularly to keep the shaft 40 in place while allowing rotation.

The main feed 28 is in flow connection with the bearings 42, particularly to lubricate the bearings 42. Thus, the feed branches 37, 38 conduct the service fluid to the bearings 42.

Figure 3:
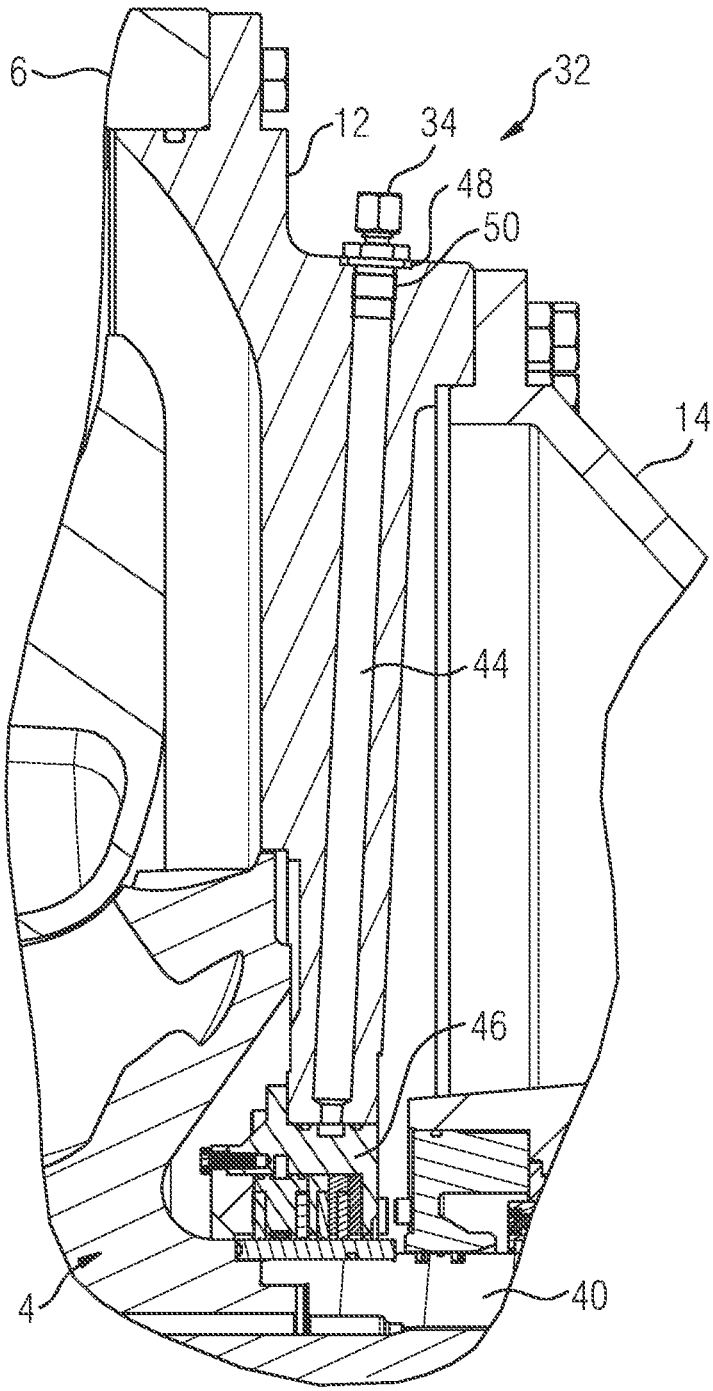
FIG. 3 is a schematic cross section of a gas supply system of the radial compressor.

FIG. 3 shows another cross section of the radial compressor 2 shown in FIG. 1. The cross section was done along the gas supply system 32 of the radial compressor 2.

The gas supply system 32 comprises a gas conduit 44 and the fitting 34, wherein the gas conduit 44 is an integral part of the housing 10, particularly of the first housing part 12. The gas conduit 44 is a hollow space formed by the walls of the housing 10, particularly formed by the walls of the first housing part 12. Further, the motor 8 of the radial compressor 2 comprises a gas sealing 46. The gas sealing 46 may be arranged on the shaft 40. Further, the gas sealing is a labyrinth sealing. Moreover, in this embodiment the gas sealing 46 is a carbon floating ring sealing.

The fitting 34 is arranged in the area of a hole top 48 (at an orifice) of the gas conduit 44. Particularly, the fitting 34 is at least partially accommodated in the hole top 48.

In this embodiment, the fitting is screwed in/to the hole top 48 of the gas conduit 44. Therefore, the hole top 48 comprises a thread 50. Thus, the fitting 34 is accessible directly from outside, particularly for supplying the gas conduit 44 with a gas. Further, the gas can enter the housing 10, particularly the gas supply system 32, through the fitting 34. The gas is sealing air like nitrogen. Further, the gas is compressed/pressurised.

The gas conduit 44 connects the fitting 34 with the gas sealing 46 of the radial compressor 2, particularly to seal the shaft 40. Thus, the gas is conductible/conducted through the gas conduit 44 towards the gas sealing 46. Further, the gas supply system 32 conducts the gas to the gas sealing 46.

A gas supply (not shown) can be connected to the fitting 34 to supply the gas supply system 32 with gas.

Figure 4:
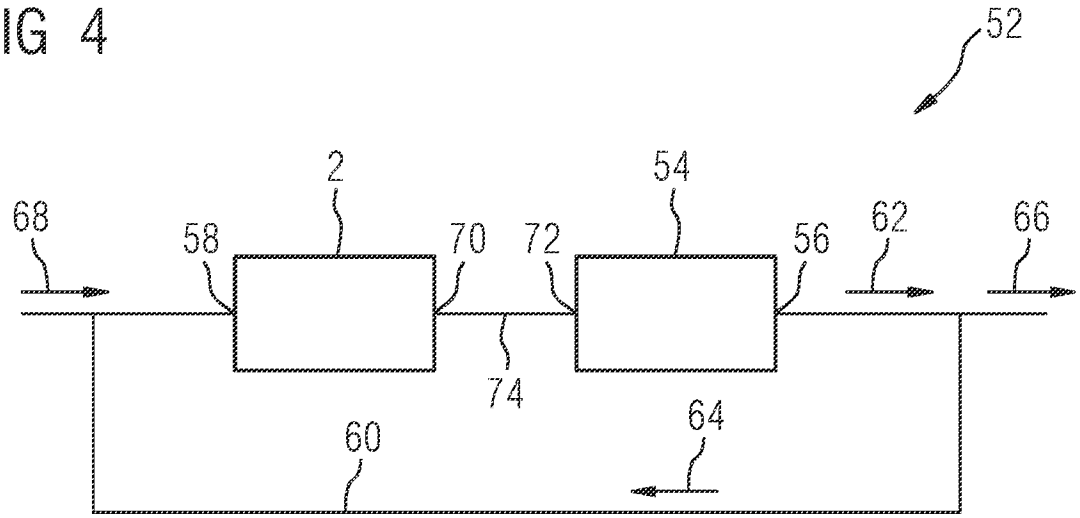
FIG. 4 is a schematic overview of an exhaust gas recirculation system.

FIG. 4 schematically shows an exhaust gas recirculation system 52 comprising the radial compressor according to FIGS. 1 to 3, to which is referred. Further, the exhaust gas recirculation system 52 comprises a combustion chamber 54.

An output 56 of the combustion chamber 54 is connected with an input 58 of the radial compressor 2, particularly by means of a recirculation conduit 60.

Exhaust 62 is released from the combustion chamber 54 over the output 56 of the combustion chamber 54.

The exhaust gas recirculation system 52 is embodied to conduct at least a first part 64 of the exhaust 62 of the combustion chamber 54 to the radial compressor 2, particularly by means of the recirculation conduit 60. A second part 66 of the exhaust 62 may be released to the environment.

The radial compressor 2 compresses at least the part 64 of the exhaust 62, which was conducted to it. Additionally, also fresh air 68 may be conducted to the radial compressor 2, which may be compressed as well by means of the radial compressor 2.

Moreover, an output 70 of the radial compressor 2 is connected to an input 72 of the combustion chamber 54, particularly by means of a connection conduit 74.

The exhaust gas recirculation system 52 is embodied to conduct at least the compressed exhaust to the combustion chamber 54. The compressed exhaust may be conducted together with the compressed air to the combustion chamber 54.

The exhaust gas recirculation system 52 may reduce $NO_x$ emissions.

While specific embodiments have been described in detail, those with ordinary skill in the art will appreciate that various modifications and alternatives to those details could be developed in light of the overall teachings of the disclosure. For example, the particular arrangements disclosed are meant to be illustrative only and should not be construed as limiting the scope of the claims or disclosure, which are to be given the full breadth of the appended claims, and any equivalents thereof.

We claim:

1. A radial compressor comprising:
an impeller;
a motor having a longitudinally extending shaft, the motor configured to rotatably drive the shaft, and the shaft configured to rotatably drive the impeller;
a housing for the motor; and
a motor lubrication fluid distribution system comprising a main feed, a manifold and at least two feed branches and configured to conduct the lubrication fluid from the main feed to the manifold and then to the feed branches;
wherein the housing is configured as several interconnected housing parts arranged in sequential longitudinal adjacency along the shaft;
wherein the distribution system is an integral part of the housing, extending through at least two of the housing parts; and
wherein the feed branches extend in opposite longitudinal directions from the manifold.

2. The radial compressor of claim 1 wherein the lubrication fluid is oil.

3. The radial compressor of claim 1, wherein at least one of the feed branches extends through at least two of said housing parts.

4. The radial compressor according to claim 1 configured as an exhaust gas recirculation compressor.

5. The radial compressor according to claim 3 configured as an exhaust gas recirculation compressor and further comprising:
at least one compressor bearing;
wherein the main feed is in flow connection with and to lubricate the at least one compressor bearing.

6. The radial compressor of claim 5 further comprising a connector for attaching a supply of lubrication fluid to the main feed, wherein the connector is a flange connection accessible directly from outside the housing.

7. The radial compressor of claim 6 wherein the housing comprises a base body and a protrusion, and wherein the protrusion comprises at least a part of the distribution system and is arranged at the base body.

8. The radial compressor of claim 5 further comprising:
a gas sealing system for gas-sealing the motor comprising:
a gas sealing member for sealing the motor in response to pressurized gas applied thereto;
a gas conduit formed as a hollow passage extending in a wall of the housing for conducting pressurized gas toward the gas sealing member; and
a fitting disposed in the housing at one end of the gas conduit for receiving pressurized gas;
whereby the pressurized gas received by the fitting is delivered to the sealing member via the gas conduit.

9. The radial compressor of claim 1, further comprising:
at least one compressor bearing;
wherein the main feed is in flow connection with the at least one bearing to lubricate the at least one bearing.

10. The radial compressor of claim 9 further comprising a connector for attaching a supply of lubrication fluid to the main feed.

11. The radial compressor of claim 10, wherein the connector is a flange connection accessible directly from outside the housing.

12. The radial compressor of claim 1 wherein the housing comprises a base body and a protrusion, and wherein the protrusion comprises at least a part of the distribution system and is arranged at the base body.

13. The radial compressor of claim 1 further comprising:
a gas sealing system for gas-sealing the motor comprising:
a gas sealing member for sealing the motor in response to pressurized gas applied thereto;
a gas conduit formed as a hollow passage extending in a wall of the housing for conducting pressurized gas toward the gas sealing member; and
a fitting disposed in the housing at one end of the gas conduit for receiving pressurized gas;
whereby the pressurized gas received by the fitting is delivered to the sealing member via the gas conduit.

14. The radial compressor of claim 13 wherein the fitting is a connecting element for attaching a pressurized gas supply to the gas sealing system.

15. The radial compressor of claim of claim 14 in combination with an exhaust gas recirculation system and a combustion chamber having an input and an output:
wherein the radial compressor has an input and an output; and
wherein the output of the combustion chamber is connected in flow communication to the input of the radial compressor, and an output of the radial compressor is connected in flow communication to the input of the combustion chamber.

16. The radial compressor of claim of claim 1 in combination with an exhaust gas recirculation system and a combustion chamber having an input and an output:

wherein the radial compressor has an input and an output; and wherein the output of the combustion chamber is connected in flow communication to the input of the radial compressor, and an output of the radial compressor is connected in flow communication to the input of the combustion chamber.

* * * * *